United States Patent [19]

Piatti et al.

[11] 4,381,954

[45] May 3, 1983

[54] METHOD OF INCREASING THE DUCTILITY OF ARTICLES FORMED FROM SUPERPLASTIC ALLOY AND ARTICLE

[75] Inventors: Giovanni Piatti, Varese; Giovanni Pellegrini, Caravate, both of Italy

[73] Assignee: European Atomic Energy Community (EURATOM), Batiment Jean Monnet, Plateau du Kirchberg, Luxembourg

[21] Appl. No.: 212,587

[22] Filed: Dec. 3, 1980

[30] Foreign Application Priority Data

Dec. 17, 1979 [LU] Luxembourg ..... 82002

[51] Int. Cl.[3] ..... C22F 1/04

[52] U.S. Cl. ..... 148/2; 148/11.5 A; 148/437; 420/902

[58] Field of Search ..... 148/11.5 A, 2, 32, 32.5

[56] References Cited

U.S. PATENT DOCUMENTS 4,126,448 11/1978 Moore et al. ..... 148/11.5 A

*Primary Examiner*—R. Dean

*Attorney, Agent, or Firm*—Pennie and Edmonds

[57] ABSTRACT

A method of increasing the ductility of articles formed from a superplastic alloy, the superplastic alloy consisting of aluminium, from 5 to 10% by weight of calcium and at most 1% by weight of impurities, characterized in that these articles, after their superplastic forming, are heated for at least 30 minutes to a temperature of between 400° C. and 600° C.

5 Claims, No Drawings

METHOD OF INCREASING THE DUCTILITY OF ARTICLES FORMED FROM SUPERPLASTIC ALLOY AND ARTICLE

BACKGROUND OF THE INVENTION

1. Field of the Invention

The present invention relates to a method of increasing the ductility of articles formed from superplastic alloy.

2. Prior Art

In our British Pat. No. 1,452,646, a process is described for the preparation of superplastic aluminium/-calcium alloys. This patent disclosed aluminium alloys containing from 5 to 10% by weight of calcium, preferably 7.6% calcium, with a maximum of 1% by weight of impurities. These alloys are prepared by melting all their pure constituents together in the absence of oxygen, after which the alloy is subjected to mechanical treatment at a temperature of at least 270° C. This mechanical treatment comprises rolling, pressing and working of this type.

The alloys thus obtained exhibit excellent properties of superplasticity and corrosion resistance. However, articles obtained by the superplastic deformation (using the conventional methods of experts in superplastic forming) of sheets, tubes etc. of these alloys have less ductility at the utilization temperature than the usual commercial alloys of aluminium.

It is an object of the present invention to provide articles formed from superplastic alloy having improved ductility.

SUMMARY OF THE INVENTION

It has now been found that the ductility of articles made from these Al-Ca alloys by means of working using superplastic forming can be considerably improved by heating these articles to a temperature of between 400° C. and 600° C., preferably 550° C., for a period of at least 30 minutes.

DESCRIPTION OF THE PREFERRED EMBODIMENT

The improvement in ductility is evident from the Table below, in which the reference numeral 1 relates to superplastically-formed articles (at a rate of 10% elongation at 400° C.) which, however, have not undergone the above-mentioned thermal treatment, and the reference numeral 2 relates to the same superplastically-formed articles which have undergone this treatment.

The values indicated relates to a rate of deformation of $3.33\times10^{-5}$ $ms^{-1}$ (0.2 cm/min).

| | Su (Mpa · $m^{-2}$) | $S_{0.2}$ (Mpa · $m^{-2}$) | $E_{pb}$ (%) | $E_{pu}$ (%) |
|---|---|---|---|---|
| 1 | 210 | 150 | 8.7 | 8.4 |
| 2 | 200 | 140 | 12.5 | 12.0 |

The disclosure of British Pat. No. 1,452,646 is incorporated herein by reference thereto.

What is claimed is:

1. A method of producing articles formed from a superplastic aluminum base alloy having improved ductility comprising:

melting together in the absence of oxygen a mixture consisting of 5 to 10% by weight calcium and not more than 1% impurities and the remainder aluminum;

subjecting the resulting alloy to mechanical treatment at a temperature of at least 270° C.;

superplastic forming the desired article;

heating the formed article to a temperature of between 400° C. and 600° C. for at least 30 minutes.

2. A method as claimed in claim 1 wherein the superplastic alloy contains 7.6% by weight of calcium.

3. A method as claimed in claim 1 wherein the articles are heated to 550° C.

4. A method as claimed in claim 2 wherein the articles are heated to 550° C.

5. An article produced by the method of claim 1.

* * * * *